US006867380B2

(12) United States Patent
Miki et al.

(10) Patent No.: US 6,867,380 B2
(45) Date of Patent: Mar. 15, 2005

(54) ELECTRONIC APPARATUS

(75) Inventors: Ryuji Miki, Hyogo (JP); Hirofumi Takemasa, Osaka (JP); Yoshihiro Fujimoto, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/394,792

(22) Filed: Mar. 21, 2003

(65) Prior Publication Data

US 2003/0196880 A1 Oct. 23, 2003

(30) Foreign Application Priority Data

Mar. 29, 2002 (JP) ..... 2002-096465

(51) Int. Cl.[7] ..... H01H 9/26
(52) U.S. Cl. ..... 200/5 R; 200/5 A
(58) Field of Search ..... 200/5 R, 1 B, 200/17 R, 18, 600, 512, 517, 61.85, 341, 332.2, 5 A, 61.54, 329, 338

(56) References Cited

U.S. PATENT DOCUMENTS

| | | | | | |
|---|---|---|---|---|---|
| 4,247,600 | A | * | 1/1981 | Adachi | 428/607 |
| 4,574,651 | A | * | 3/1986 | Nordstrom | 74/471 XY |
| 5,153,362 | A | * | 10/1992 | Toda et al. | 84/625 |
| 5,668,357 | A | * | 9/1997 | Takiguchi et al. | 200/5 R |
| 5,788,688 | A | * | 8/1998 | Bauer et al. | 606/1 |
| 5,864,105 | A | * | 1/1999 | Andrews | 200/5 R |
| 5,945,646 | A | * | 8/1999 | Miller et al. | 200/5 R |
| 6,239,392 | B1 | * | 5/2001 | Serizawa et al. | 200/5 R |
| 6,563,061 | B2 | * | 5/2003 | Takahashi | 200/5 A |
| 6,621,024 | B1 | * | 9/2003 | Bello | 200/302.2 |

* cited by examiner

*Primary Examiner*—Elvin Enad
*Assistant Examiner*—Lisa Klaus
(74) *Attorney, Agent, or Firm*—RatnerPrestia

(57) ABSTRACT

An electronic apparatus, which performs properly with reliability even in an operation through blind-touch, is provided. The electronic apparatus includes a first switch section made up of at least one push switch, a second switch section made up of at least one push switch, and a long and protruding section placed rigidly between the first and the second switch sections.

5 Claims, 6 Drawing Sheets

PRIOR ART

ELECTRONIC APPARATUS

FIELD OF THE INVENTION

The present invention relates to an operating section of electronic apparatuses, and more particularly, it relates to an operating section easy for blind-touch of video cameras.

BACKGROUND OF THE INVENTION

Electronic apparatuses including video cameras have been recently sophisticated, and the market has been requesting "easy of use". Business-grade video cameras used in broadcasting stations or production companies, in particular, are operated by monitoring a viewfinder. Thus the operation through blind-touch is expected free from errors.

The operating section of a conventional video camera is described hereinafter. FIG. 6 shows a perspective view of a conventional electronic apparatus. In FIG. 6, apparatus housing 101 accommodates image-pickup means which picks up an image passing through optical inputting section 102 disposed at the front of housing 101. The image picked up is output as a video signal to outside or stored in memory means such as magnetic tape, optical disc, or semiconductor memory by recording means (not shown) disposed in housing 101. A user who shoots images monitors viewfinder 103 for confirming the images. An upper face of housing 101 retains viewfinder 103 such that viewfinder 103 is projected from a rear face of housing 101. The user's right hand grasps a grip (not shown) prepared on right face 105 of housing 101, and the left hand supports optical input section 102, thereby holding the electronic apparatus. In this case, the user turns a rotary adjusting section 108, such as a focus ring, an iris ring and a zoom ring on optical input section 102 with the left hand for adjusting optical input section while monitoring viewfinder 103 with the right eye. Further, in some instances, the user shifts the left hand slightly this side and uses the thumb to manipulate push-switch cluster 104 prepared on left-side face 106 of housing 101.

The foregoing conventional structure; however, relies on guesswork when a user operates the push-switch cluster 104 because the operation is done through blind-touch, which sometimes makes errors.

In order to overcome this problem, small protrusions are formed on surfaces of the push-switches for users to sense which switch is now touched. However, in an extreme cold site, a user with gloves cannot sense the protrusions and makes errors. Further, there are some cases that an unintentional touch would operate some push-switches.

SUMMARY OF THE INVENTION

An apparatus of the present invention comprises the following elements:

- a first switch section formed of at least one push switch;
- a second switch section formed of at least one push switch; and
- a protruding and long section placed rigidly between the first and second switch sections.

DETAILED DESCRIPTION OF THE PREFERRED EMBODIMENTS

The present invention addresses the problem discussed above, and aims to provide an electronic apparatus that performs properly through blind-touch. The present invention also aims to provide an electronic apparatus that accepts only operations with a thumb or at least one of fingers kept touching the operation section. Exemplary embodiments of the present invention are demonstrated hereinafter with reference to the accompanying drawings.

Exemplary Embodiment 1

Figure 1:
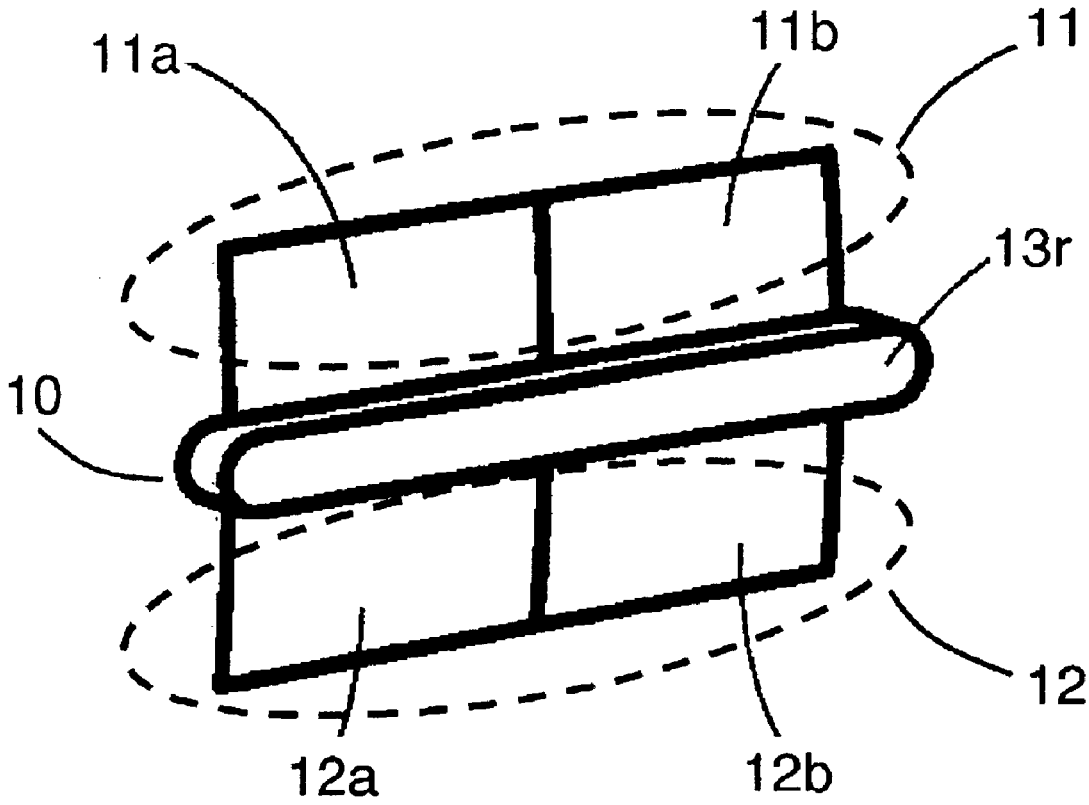
FIG. 1 is a perspective view illustrating a structure of an electronic apparatus in accordance with a first exemplary embodiment of the present invention.

FIG. 1 is a perspective view illustrating a structure of an electronic apparatus in accordance with the first exemplary embodiment of the present invention. In FIG. 1, push-switch cluster 10 is made up of first switch section 11 formed of push-switch 11*a*, push-switch 11*b* and second switch section 12 formed of push-switch 12*a*, push-switch 12*b*. Center runner 13*r* is placed rigidly and partitions first switch section 11 (upper push-switch 11*a* and push-switch 11*b*) from second switch section 12 (lower push-switch 12*a* and push-switch 12*b*.) Center runner 13*r* protrudes by 2–3 mm.

In this embodiment, center runner 13*r* is rigidly placed and shaped like a long and protruding form; however, it is not necessarily limited to this shape. The length of center runner 13*r* is approx. the same as the adjacent sides of first and second switch sections 11 and 12. In this embodiment, four push-switches are prepared; however, the number of switches is not limited to four.

An operation of the electronic apparatus thus structured is demonstrated hereinafter with reference to FIG. 1. A user, who shoots images with the electronic apparatus, turns a rotary adjusting section with the thumb or index finger of the left hand holding an optical input section with the left palm, while grasping a grip disposed on the right side face with the right hand. The rotary adjusting section includes a focus ring, iris ring, zoom ring and the like.

Figure 2:
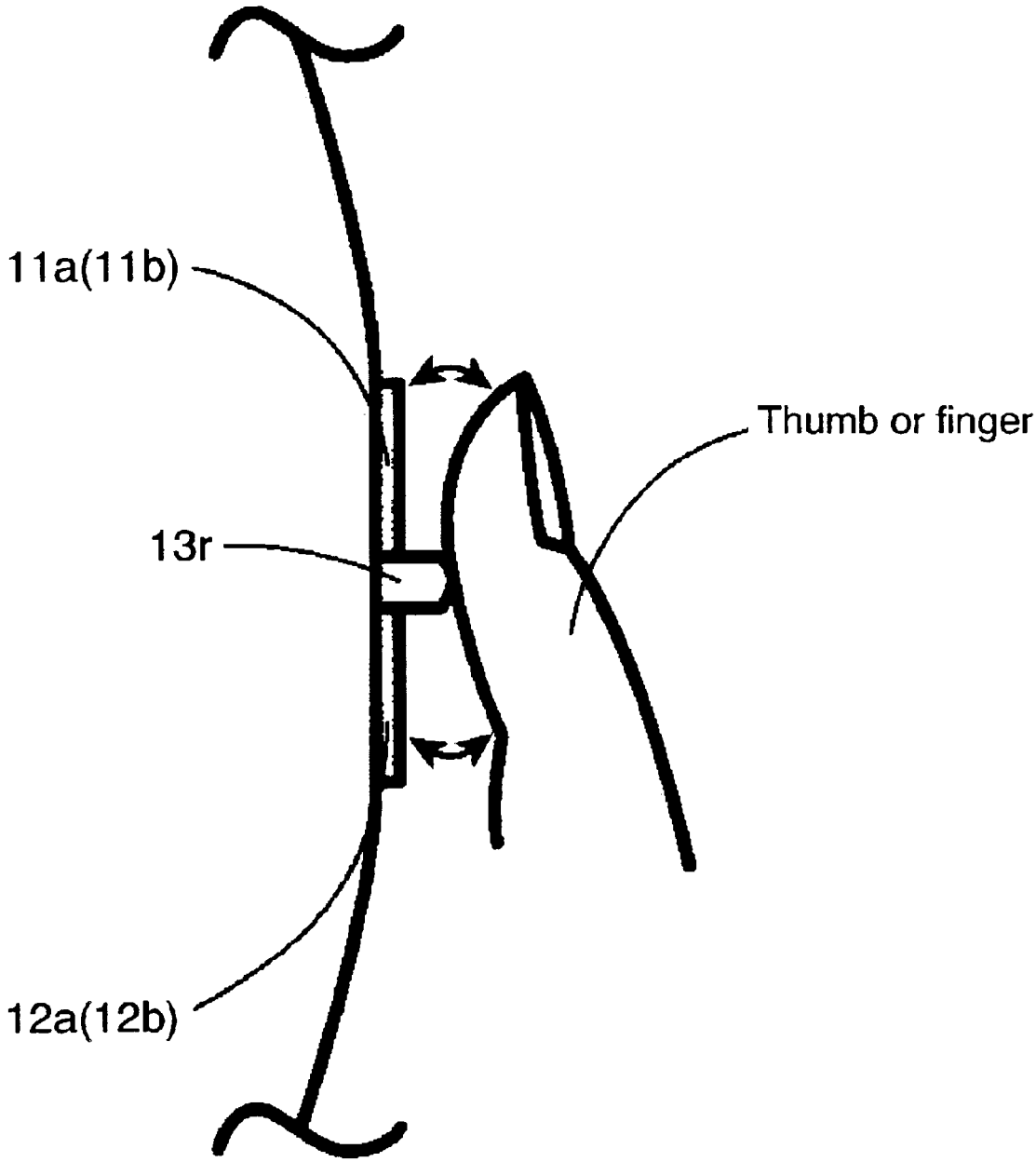
FIG. 2 is a schematic drawing illustrating an operation of the electronic apparatus in accordance with the first exemplary embodiment.

The thumb or at least one of the fingers are shifted this side to manipulate push-switch cluster 10 when necessary. If the thumb is used, the base of thumb (articulations carpometacarpeae) and the wrist (articulations intercarpeae) can move the thumb. FIG. 2 illustrates this operation. When the user wants to push upper push-switch 11*a* or push-switch 11*b* of push-switch cluster 10, the user places the thumb or at least one of fingers on center runner 13*r*. In the case of holding the optical input section such that as if the left palm wrapped the optical input section from the lower side, the thumb manipulates the switches in the ordinal way. The thumb is tilted upward, so that it can push upper push-switch 11*a* or push switch 11*b*. Bending of the first and second joints allows the thumb to operate the switches. Those joints are the first and the second joints counted from the tip of the thumb, namely, they are articulations interphalangeae and articulations metacarpophalangeae.

On the other hand, when the user wants to push lower push-switch 12*a* or push-switch 12*b*, the user tilts the thumb downward while placing the thumb on center runner 13*r*, so that those switches are pushed by the thumb. In other words, the thumb or at least one of fingers moves like a seesaw using center runner 13*r* as a fulcrum, thereby operating push-switch cluster 10.

When the user wants to push upper push-switch 11*a* or push-switch 11*b*, the foregoing operation can do it; however, when the user wants to push lower push-switch 12*a* or push switch 12*b*, the user shifts the thumb slightly downward from center runner 13*r*, thereby pushing those switches instead of the foregoing operation. In this case, the user can also push lower push-switch 12*a* or push-switch 12*b* while the user keeps touching center runner 13*r* with a tip of the thumb, and the thumb's first and second joints can be bent for the operation.

According to the first exemplary embodiment discussed above, center runner 13*r* works as a guide of pushing a switch in push-switch cluster 10 with a thumb or at least one of fingers, so that the switches can be operated with reliability.

Exemplary Embodiment 2

Figure 3:
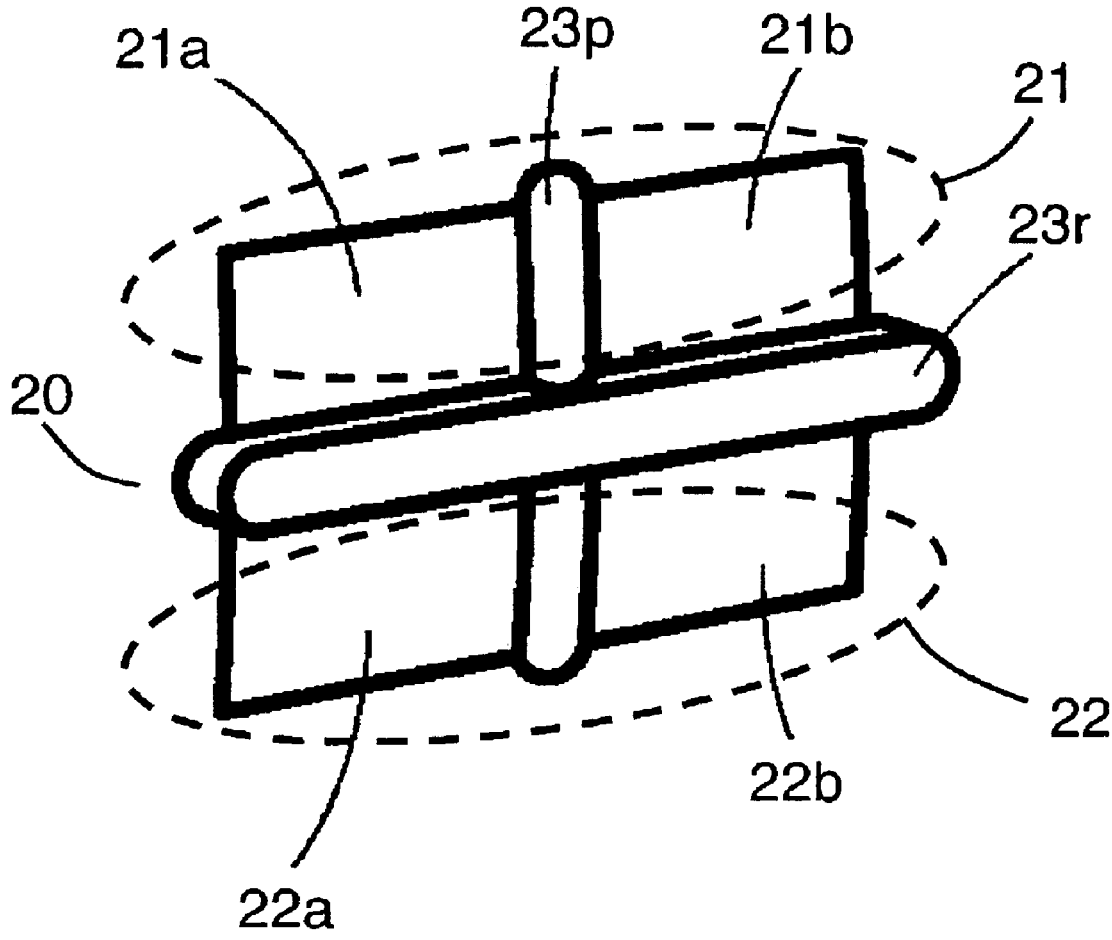
FIG. 3 is a perspective view illustrating a structure of an electronic apparatus in accordance with a second exemplary embodiment of the present invention.

FIG. 3 shows a perspective view illustrating a structure of a push-switch cluster of an electronic apparatus in accordance with the second exemplary embodiment. In FIG. 3, push-switch cluster 20 is made up of first switch section 21 formed of upper push-switch 21*a*, upper push-switch 21*b* and second switch section 22 formed of lower push-switch 22*a*, lower push-switch 22*b*. Center runner 23*r* is similar to center runner 13*r* used in the first embodiment. Partition runner 23*p* works in a similar way to center runner 13*r* detailed in FIG. 1, and is placed rigidly such that it partitions upper push-switch 21*a* from push-switch 21*b* as well as lower push-switch 22*a* from push-switch 22*b*.

Center runner 23*r* is shaped like a long and protruding form; however, it is not limited to this shape. The length of runner 23*r* is approx. the same as the adjacent sides of first and second switch sections 21 and 22.

Partition runner 23*p* is shaped like a sub longer and protruding form, but not limited to this shape. Runner 23*p* crosses runner 23*r*.

This structure allows a thumb or other fingers to push the push-switches distinctly because center runner 23*r* distinguishes the upper push-switches from the lower push-switches as well as partition runner 23*p* distinguishes the switches (switches 21*b*, 22*b*) on this side from those (switches 21*a*, 22*a*) on that side. In other words, when a user wants to operate switch 21*a* on upper and that side, the user can push the switch while the user keeps touching center runner 23*r* with the thick of the thumb or at least one of fingers and feeling the presence of partition runner 23*p* this side of the finger. In a similar way, when the user wants to operate push-switch 22*b* on lower and this side, the user can push the switch while the user keeps touching center runner 23*r* with a tip of the thick of the thumb or at least one of fingers and feeling the presence of partition runner 23*p* that side of the thumb or at least one of fingers.

This structure exerts the foregoing advantage in the case of four switches (two switches on upper and lower sides respectively). However this advantage can be recognized in the case of larger numbers of switches, e.g., in the case where three switches are prepared on upper side (left, middle, right) and lower side respectively.

Figure 4A:
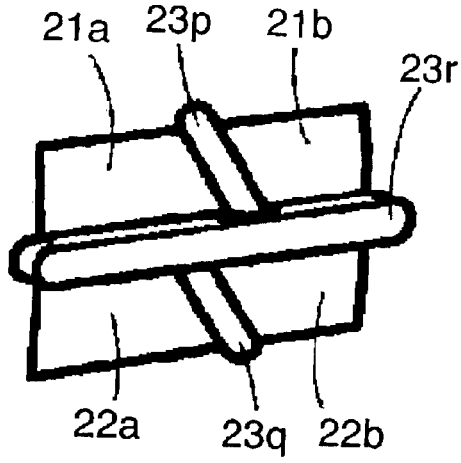
FIG. 4 is a perspective view illustrating a structure of another electronic apparatus in accordance with the second exemplary embodiment of the present invention.
Figure 4B:
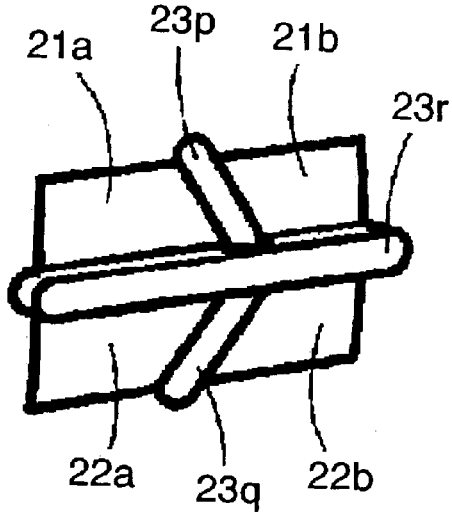
Figure 4C:
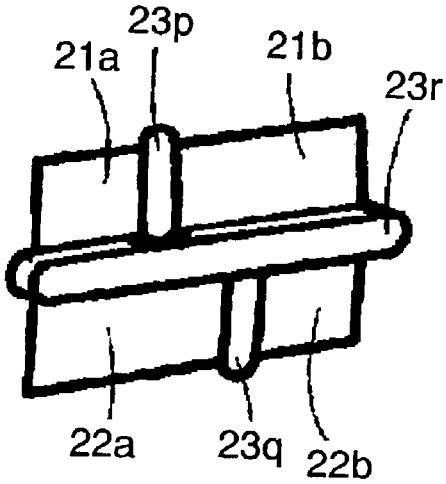

The partition runner does not necessarily cross the center runner at right angles as described in this second embodiment. To be more specific, as shown in FIG. 4A, partition runners 23*p* and 23*q* can be slanted with respect to center runner 23*r*, or as shown in FIG. 4B, partition runners 23*p* and 23*q* can be bent such that they have a summit on center runner 23*r*. As shown in FIG. 4C, partition runners 23*p* and 23*q* can be asymmetrical about center runner 23*r*. In those three cases, a user can sense center runner 23*r*, partition runners 23*p* and 23*q* with the thick of a thumb or at least one of fingers, thereby operating the push-switches through blind-touch properly.

Exemplary Embodiment 3

The exemplary embodiments 1 and 2 previously discussed allow the users to recognize the switches properly in a mechanical way. This third embodiment eliminates errors in operating the push-switch cluster in an electronic way making full use of the center runner as a guide for a thumb or other fingers.

Figure 5:
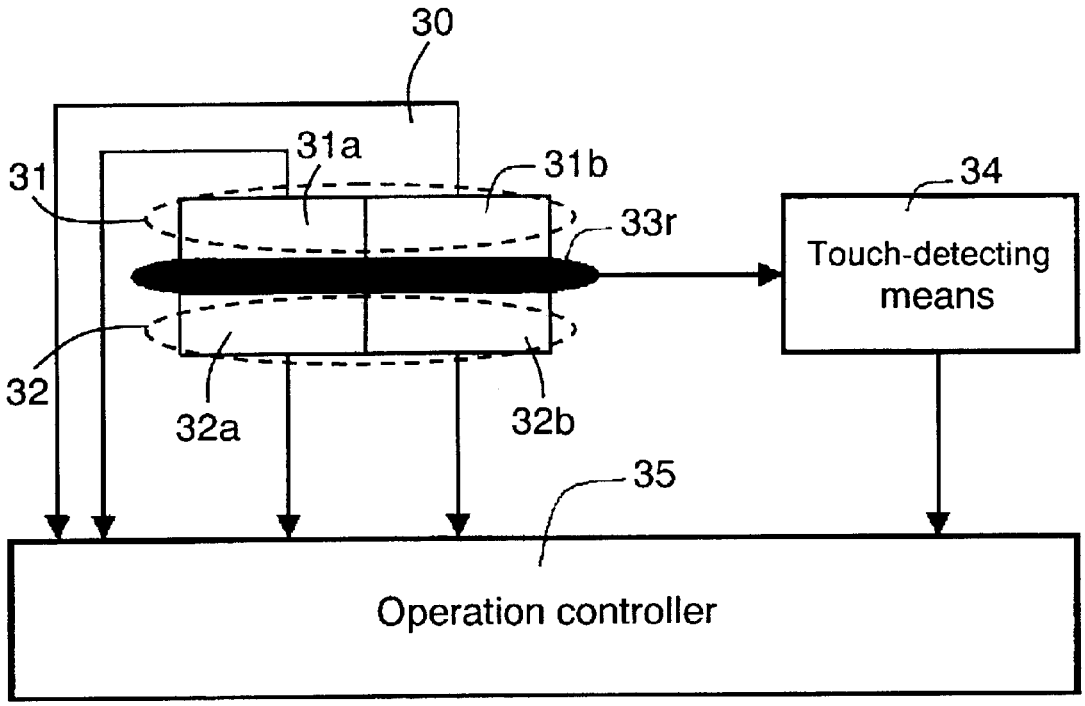
FIG. 5 is a perspective view illustrating a structure of an electronic apparatus in accordance with a third exemplary embodiment of the present invention.

FIG. 5 is a block diagram of an electronic apparatus in accordance with the third embodiment. In FIG. 5, push-switch cluster 30 corresponds to cluster 10 in FIG. 1 and cluster 20 in FIG. 3, and center runner 33*r* corresponds to center runner 13*r* in FIG. 1 and center runner 23*r* in FIG. 3. Center runner 33*r* is an example of a long and protruding section placed rigidly. Push switches 31*a*, 31*b* correspond push switches 11*a*, 11*b* in FIG. 1 and push switches 21*a*, 21*b* in FIG. 3. Push switches 32*a*, 32*b* correspond to push switch 12*a*, 12*b* in FIG. 1 and push switches 22*a*, 22*b* in FIG. 3. First switch section 31 is formed of push switches 31*a* and 31*b*, and corresponds to first switch section 11 in FIG. 1 and first switch section 21 in FIG. 3. Second switch section 32 is formed of push switches 32*a* and 32*b*, and corresponds to second switch section 12 in FIG. 1 and second switch section 22 in FIG. 3. In this embodiment, four push-switch in clusters 30 are shown for the description purpose, but the number of switches is not limited to four.

Figure 6:
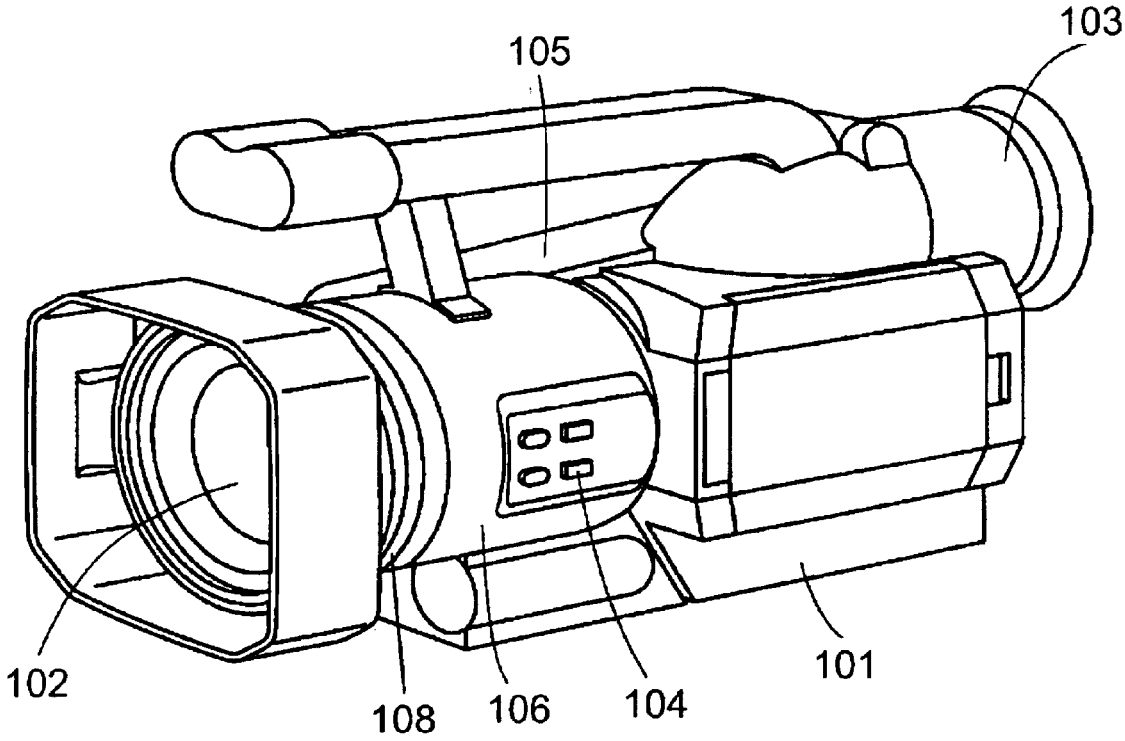
FIG. 6 is a perspective view illustrating a structure of a conventional electronic apparatus.

First and second switch sections 31 and 32 are placed near a rotary adjusting section as described in FIG. 6, and center runner 33*r* crosses a rotational direction of the rotary adjusting section at approx. right angles.

At least the surface of center runner 33*r* is made of conductive metal; however, center runner 33*r* is not conductive with the housing of the apparatus. (Since business-grade video cameras used in broadcasting stations and production companies should bear hostile environments and rough handling, the housing of the cameras are made from metal.) An electric potential of center runner 33*r* is fed into touch-detecting means 34, which is, e.g., formed of an electrostatic sensor, and always senses an electrostatic capacity of center runner 33*r* and outputs the sensed capacity to operation controller 35. Push switches 31*a*, 31*b*, 32*a* and 32*b* are independently coupled to controller 35, so that they are monitored whether or not they are pushed. In response to pushing a switch, controller 35 runs a function program assigned to each one of push switches 31*a*, 31*b*, 32*a* and 32*b*, so that the function such as auto-focus, iris-setting and the like is executed. The function program has been installed in controller 35 in advance. In this case, operation controller 35 performs a program assigned to anyone of the switches only when push-switches 31*a*, 31*b*, 32*a* or 32*b* is pushed with center runner 33*r* kept being touched.

The foregoing structure prevents push-switch cluster 30 from being erroneously operated by an unintentional touch to one of the switches, so that the function is not unintentionally performed. The functions assigned to push-switch cluster 30 are thus positively executed, and an erroneous operation due to a simple or careless touch to push-switch cluster 30 can be prevented without fail.

In the exemplary embodiments, a business-grade video camera is used as an example of electronic apparatuses;

however, the present invention is not limited to video cameras. It is applicable to other electronic apparatuses in which an rotary adjusting ring is not available nearby. In other words, when a user operates one of those apparatuses through blind-touch by the thumb or at least one of the fingers although the user's thumb or at least one of the fingers are off during non-operation period, the user can recognize the presence of push-switches using a long and protruding section placed rigidly, namely, a center runner, as a guide for the thumb or other fingers. The push switches, placed roughly in a symmetrical manner with respect to the long and protruding section, can be operated with the thick of the thumb or at least one of fingers situated on the long and protruding section.

In the previous embodiments (particularly in the drawings), the surfaces of the push switches before pressed are approx. flush with the apparatus housing; however the surfaces can be protruded from the housing. Push switches are placed closely to the center runner; however, not to mention, they can be spaced from the center runner for a thumb or other fingers to operate the switches.

As discussed above, even if the push switches that are not always kept being touched can be positively operated through blind-touch because of the presence of the center runner as a guide for a finger.

Depending on a structure in the embodiments, a thumb or at least one of fingers operating the rotary adjusting ring can be shifted along a direction crossing with the rotation axis, so that the thumb or at least one of fingers can touch the push switches with recognising the long and protruding section rigidly. Further, the thumb or at least one of fingers can positively operate the switches using the long and protruding section as a guide. Both of the first and second switch sections are placed on both sides respectively of the long and protruding section, so that a user can push each push switch without fail by bending the thumb or at least one of the fingers touching the long and protruding section.

A sub long and protruding section is prepared such that it crosses the long and protruding section. This structure allows a user to recognize individually the push switches, placed in parallel with the long and protruding section, i.e., the center runner, by sensing with the thumb or other fingers. As a result, the switches are pushed free from errors.

What is claimed is:

1. An electronic apparatus comprising:

a first switch section formed of at least one push-switch;

a second switch section formed of at least one push-switch;

along and protruding section placed rigidly between said first switch section and said second switch section;

touch-detecting means for detecting a user touching said long and protruding section; and an operation controller for detecting one of the push switches being pushed and then executing a function assigned to the switch pushed, wherein said controller determines the push operation effective only when said touch-detecting means detects said long and protruding section being touched.

2. The electronic apparatus of claim 1 further comprising, a rotary adjusting section for providing an adjustment to said electronic apparatus, said rotary adjusting section disposed near said first switch section and said second switch section, wherein longitudinal direction of said long and protruding section crosses a rotating direction of said rotary adjusting section at approximately right angles.

3. The electronic apparatus of claim 1, wherein a length of said long and protruding section is approx. the same as lengths of adjacent sides of said first switch section and said second switch section.

4. The electronic apparatus of claim 1 further comprising:

a long and protruding sub-section placed rigidly along a longitudinal direction of said long and protruding section together with push switches comprising said first switch section, wherein said sub-section is sandwiched by the push switches comprising said first switch section; and another long and protruding sub-section placed rigidly along the longitudinal direction of said long and protruding section together with push switches comprising said second switch section, wherein said another sub-section is sandwiched by the push switches comprising said second switch section, wherein said sub-section and said another sub-section cross said long and protruding section.

5. The electronic apparatus of claim 1, wherein said first switch section and said second switch section being on substantially a same plane, with said long and protruding section extending further outward of said plane than said first switch section and second switch section.

* * * * *

UNITED STATES PATENT AND TRADEMARK OFFICE

CERTIFICATE OF CORRECTION

PATENT NO. : 6,867,380 B2
DATED : March 15, 2005
INVENTOR(S) : Ryuji Miki et al.

It is certified that error appears in the above-identified patent and that said Letters Patent is hereby corrected as shown below:

Column 6,
Line 3, “along” should read -- a long --.

Signed and Sealed this

Twenty-seventh Day of September, 2005

JON W. DUDAS
*Director of the United States Patent and Trademark Office*